United States Patent [19]

Velasco et al.

[11] Patent Number: 4,961,837

[45] Date of Patent: Oct. 9, 1990

[54] PROCESS FOR THE PRODUCTION OF PETROLEUM TAR PITCH FOR USE AS A BINDER IN THE PRODUCTION OF ELECTRODES

[75] Inventors: Leon Velasco; Carlos Mota; Domingo Rodriguez, all of Caracas, Venezuela

[73] Assignee: Intevep, S.A., Caracas, Venezuela

[21] Appl. No.: 345,203

[22] Filed: Apr. 28, 1989

[51] Int. Cl.[5] ..... C10G 9/16

[52] U.S. Cl. ..... 208/41; 208/39; 208/40

[58] Field of Search ..... 208/39, 40, 41

[56] References Cited

U.S. PATENT DOCUMENTS

| | | | |
|---|---|---|---|
| 2,305,440 | 12/1942 | Summit | 208/40 |
| 3,318,801 | 5/1967 | Alexander et al. | 208/40 |
| 3,673,077 | 6/1972 | Roza | 208/40 |
| 3,725,240 | 4/1973 | Baum | 208/40 |
| 4,039,423 | 8/1977 | Moyle | 208/4 |
| 4,243,513 | 1/1981 | Horowitz et al. | 208/44 |
| 4,271,006 | 6/1981 | Dickakian | 208/40 |
| 4,363,715 | 12/1982 | Dickakian | 208/40 |
| 4,581,124 | 6/1981 | Gomi et al. | 208/34 |
| 4,663,022 | 5/1987 | Gomi et al. | 208/34 |
| 4,705,618 | 11/1987 | Suchitani et al. | 208/40 |

*Primary Examiner*—Helane Myers

*Attorney, Agent, or Firm*—Bachman & LaPointe

[57] ABSTRACT

A process for the production of high quality petroleum tar pitch for use as a binder in the manufacture of electrodes for the aluminum and steel industries from a highly aromatic feed comprises fractionating the feed in an oxygen-free environment under controlled conditions so as to obtain a specific quality petroleum tar pitch.

25 Claims, 1 Drawing Sheet

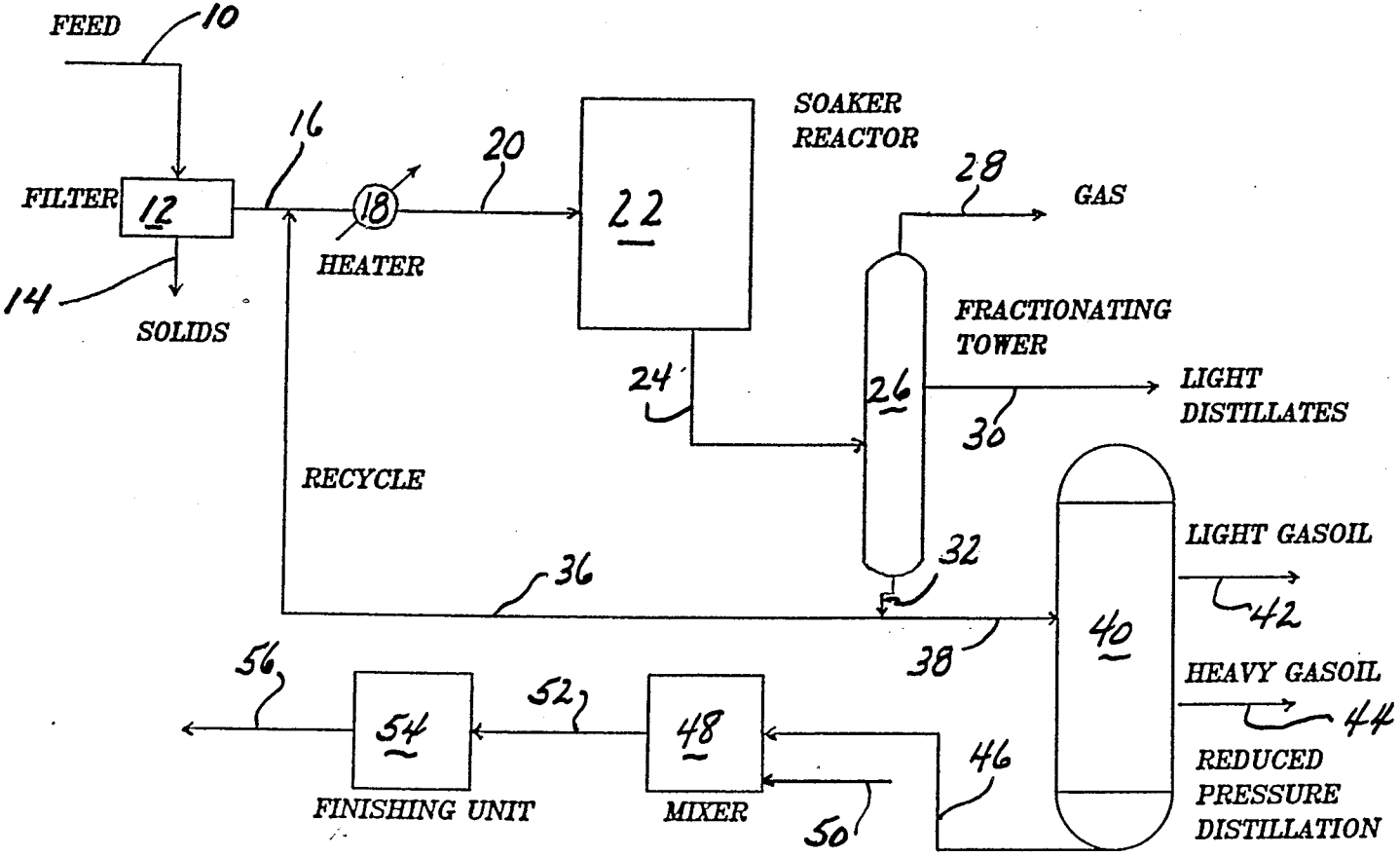
FEED
10
FILTER
12
SOLIDS
14
16
HEATER
18
20
SOAKER REACTOR
22
24
GAS
28
FRACTIONATING TOWER
26
LIGHT DISTILLATES
30
32
RECYCLE
36
38
LIGHT GASOIL
42
HEAVY GASOIL
44
REDUCED PRESSURE DISTILLATION
40
46
50
MIXER
48
52
FINISHING UNIT
54
56

PROCESS FOR THE PRODUCTION OF PETROLEUM TAR PITCH FOR USE AS A BINDER IN THE PRODUCTION OF ELECTRODES

BACKGROUND OF THE INVENTION

The present invention is drawn to a process for the production of high quality petroleum tar pitch for use as a binder in the manufacture of electrodes for the aluminum, and steel industries.

High quality petroleum tar pitch can be used in a variety of applications. One of the most important uses for high quality petroleum tar pitch is in the manufacture of anodes made from calcined petroleum coke and a binder pitch. The anodes are used in the production of primary aluminum. Presently anodes for use by the aluminum and steel industries are manufactured employing almost exclusively coal tar pitch as the binder. Coal tar pitch is a by-product of the carbonization process of mineral coal. Commercial specifications for binder pitch used in the production of electrodes are as follows:

| | HIGH S.P. PITCH | LOW S.P. PITCH |
|---|---|---|
| Conradson Carbon, (wt. %) | 56 | 40 |
| Density @ 15° C., (gr/cc) | 1.32 | 1.25 |
| Mettler Softening Point, °C. | 110–115 | 55–63 |
| Quinoline Insolubles, (wt. %) | 13–18 | 10–15 |

There have been many attempts in the past to produce petroleum tar pitch suitable for use as a binder in the manufacture of electrodes. These known processes are disclosed in U.S. Pat. Nos. 3,725,240, 4,039,423 and 4,243,513. None of the foregoing processes have been able to produce commercial petroleum tar pitch suitable for use as a binder in the manufacture of electrode for the aluminum and steel industries. Naturally, it is highly desirable to provide a process for the production of high quality tar pitch which would allow for the economic production of pitch suitable for the manufacture of electrodes.

Accordingly, it is a principal object of the present invention to provide a process for the production of petroleum tar pitch.

It is a particular object of the present invention to provide a process as set forth above wherein the quality of the petroleum pitch is suitable for use as a binder in the manufacture of electrodes.

It is a still further object of the present invention to provide a process as set forth above employing as a feed a hydrocarbon feedstock characterized by high levels of aromatics.

It is a still further object of the present invention to provide a process as set forth above which would allow for the economic production of petroleum tar pitch.

Further object and advantages of the present invention will appear hereinbelow.

SUMMARY OF THE INVENTION

In accordance with the present invention the foregoing objects and advantages are readily obtained.

The present invention relates to a process for the production of high quality petroleum tar pitch from a highly aromatic feedstock. In accordance with the present invention a feedstock is pre-heated and thereafter fed to a soaker reactor for treatment under controlled conditions so as to promote condensation and polymerization reactions. The treated feedstock is thereafter passed to a fractionating tower wherein the feedstock is fractionated into gases, light distillates and a bottom fraction stream. The bottom fraction stream is a cracked fraction which is subjected to further fractionation so as to produce light gas oil, heavy gas oil and petroleum tar pitch of a quality suitable for use as a binder in the manufacture of electrodes.

In accordance with a preferred feature of the present invention, the feedstock is admixed with a portion of the cracked fraction bottom stream which is recycled (hereinafter called recycle stream) to be admixed with the feedstock prior to processing. The amount of recycle stream added to the feedstock which allows for control of the quality of the petroleum tar pitch developed in the process of the present invention. In addition, the heating, soaker reaction and fractionating steps are preferably conducted in an oxygen-free environment and more specifically an inert environment such as argon, nitrogen or the like. By conducting the process of the present invention in an oxygen free environment, it has been found that the quality of the petroleum tar pitch and the yields of petroleum tar pitch can be increased.

It is a further preferred feature of the present invention to further treat the petroleum tar pitch produced by the process of the present invention with a refining element selected from the group consisting of finely divided carbon black, light gas oils or mixtures thereof which improve the overall quality and handability of the petroleum tar pitch.

The process of the present invention allows for the economic production of petroleum tar pitch for use in the production of electrodes in the aluminum and steel industries.

BRIEF DESCRIPTION OF THE DRAWING

The FIGURE is a schematic flow diagram illustrating the process of the present invention.

DETAILED DESCRIPTION

The present invention is drawn to a process for the production of high quality petroleum tar pitch for use as a binder in the manufacture of electrodes for the aluminum and steel industries. By high quality petroleum tar pitch is meant a petroleum pitch having the following properties:

| | |
|---|---|
| Conradson Carbon, (wt. %) | 40–60 |
| Density @ 15° C., (gr/cc) | 1.20–1.35 |
| Mettler Softening Point, (°C.) | 100–125 |
| Quinoline Insolubles, (wt. %) | 0–10 |

The process of the present invention will be described in detail with reference to the FIGURE which shows a schematic flow sheet of the process of the present invention.

With reference to the FIGURE, a fresh feedstock is delivered via line 10 for treatment in the process of the present invention. The fresh feedstock is preferably a highly aromatic hydrocarbon stream. Feedstocks suitable and preferred for the process of the present invention are characterized by the following composition and properties:

| | |
|---|---|
| Conradson Carbon, (wt. %) | 3–10 |

-continued

| | |
|---|---|
| Density @ 15° C., (gr/cc) | 0.8–1.15 |
| Solids Content, (wt. %) | 0–0.1 |
| Aromatics, (wt. %) | 65–85 |

Suitable hydrocarbon feedstocks include catalytic cracking decanted oil, lubricant extracts and mixtures thereof. The fresh feedstock as defined above can, if desired, be delivered to a filtering station 12 herein the hydrocarbon stream is filtered so as to remove excess undesirable solids so as to produce a filtered clean stream. In accordance with the present invention it is desired that the product treated in the process of the present invention have a solids content of between 0 to 0.01 wt. %. By filtering the fresh feed, the desired solid content can be obtained. Typical filtration techniques such as centrifugal, electrostatic or mechanical techniques can be used in the filtering station 12. These techniques are sufficient to remove at least 95% of the undesirable solids in the fresh feed stream. The filtered hydrocarbon stream preferably has the following composition and properties:

| | |
|---|---|
| Conradson Carbon, (wt. %) | 3–7 |
| Density @ 15° C., (gr/cc) | 0.8–1.1 |
| Solids Content, (wt. %) | 0–0.01 |
| Aromatics, (wt. %) | 65–85 |

The clean filtered stream is thereafter fed via line 16 to a heater 18 wherein the stream is pre-heated. It is desirable in the process of the present invention to mix the filtered clean stream with a recycle stream in a manner to be described hereinbelow.

The stream fed to the heater or furnace 18 is preheated to a temperature of between 380° and 480° C. and thereafter is delivered via line 20 to a soaker type reactor 22. The heated feedstock is treated in the soaker reactor 22 at a temperature of from about 360° to 460° C., a pressure of from about 1480 to 1825 kpa and a residence time of from about 1 to 5 hours. This treatment allows condensation and polymerization reactions to take place in the soaker reactor. It is preferred that the treatment in both the heater furnace and soaker reactor take place in an oxygen-free environment and, preferably an inert environment. The treated stream from the soaker 22 is delivered via line 24 to a fractionating tower 26 where the feedstock is fractionated into gases which are taken off via line 28, light distillates which are taken off via line 30 and a bottom fraction stream which is taken off via line 32. The fractionator is operated under the following operating conditions: a bottom fractionator temperature of from about 330° to 430° C. and a pressure of from about 700 to 850 kPa. The yields from the fractionating tower 26 comprises 2 to 5 wt. % $C_4-$ gases and 3 to 8 wt. % light distillates having an ASTM D-86 cut point of between 170° C. and 220° C. based on fresh feed. It is preferred that the treatment in the fractionating tower 26 take place in an oxygen free environment and, preferably, an inert environment. The bottom fraction drawn off through line 32 is a cracked fraction bottom stream having the following composition and properties:

| | |
|---|---|
| Conradson Carbon, (wt. %) | 10–18 |
| Density @ 15° C., (gr/cc) | 1.10–1.15 |
| Solids Content, (wt. %) | 0–0.01 |

-continued

| | |
|---|---|
| Aromatics, (wt. %) | 70–95 |
| Softening Point, (°C.) | <25 |

In the preferred embodiment of the present invention, a portion of the cracked fraction bottom stream is recycled and the remainder is further fractionated in the manner discussed hereinafter.

The portion of cracked fraction forming the recycle stream is preferably recycled via line 36 to line 16 where it is admixed with the fresh feed prior to delivery of the feed to the furnace 18. In accordance with the present invention, the recycle delivered via line 36 is mixed with the fresh feed in a ratio of up to 3:1 by volume of recycle to fresh feed and preferably in a ratio of about between 2:1 to 3:1. Recycling of the heavy cracked fraction via line 26 is highly desirable in order to optimize the resulting pitch properties obtained in the process of the present invention upon further fractionation.

The remainder of the cracked fraction is delivered via line 38 to a further fractionating unit 40 such as a reduced pressure distillation tower wherein the cracked fraction is further fractionated into light gas oil taken off via line 42, heavy gas oil taken off line 44 and petroleum tar pitch taken off line 46. The cracked fraction is fractionated in distillation unit 40 at a bottom fractionator temperature of between 300° to 380° C. and a pressure of between 0.3 to 15 kPa and preferably in an oxygen-free environment. The petroleum tar pitch resulting from the process of the present invention and drawn off via line 46 is a high quality petroleum pitch having the following properties:

| | |
|---|---|
| Conradson Carbon, (wt. %) | 40–60 |
| Density @ 15° C., (gr/cc) | 1.20–1.35 |
| Mettler Softening Point, (°C.) | 100–125 |
| Quinoline Insolubles, (wt. %) | 0 |

This petroleum tar pitch is of high quality and suitable for use as a binder in the manufacture of electrodes.

The yield of light gas oil taken off line 42 is between 15 to 25 wt. %, the yield of heavy gas oil taken off line 44 is from 30 to 50 wt. % and the yield of petroleum tar pitch taken off line 46 is between 25 to 50 wt. % all yields based on fresh feed. The light gas oil has an ASTM D-86 end boiling point of between 300° to 360° C. and the heavy gas oil has an ASTM D-1160 end boiling point of between 450° to 570° C. The petroleum tar pitch taken off via line 46 can, if desired, be delivered to a mixer 48 where it is mixed with an additive selected from the group consisting of finely divided carbon black, a light gas oil or mixtures thereof via line 50. In accordance with the present invention it is highly desirable to use the light gas oil taken off line 42 as the additive to the mixture 48. It is preferred that the light gas oil be mixed with the pitch in an amount of between 3 to 15 volume percent. The preferred light gas oil has the following composition and properties:

| | |
|---|---|
| ASTM D-86 Initial Boiling Point, °C. | 170–220 |
| ASTM D-86 Final Boiling Point, °C. | 300–360 |
| API Gravity | 18–28 |
| Aromatics, wt. % | 45–80 |

A finely divided carbon black is admixed with the petroleum pitch in mixer 48. The proportion of the carbon black mixed with the petroleum pitch should be between 5 to 20 wt. %. Suitable carbon black for use in the process of the present invention has the following properties:

| | |
|---|---|
| Average Particle Size, microns | 12–20 |
| Apparent Bulk Density, gr/cc | 0.46–0.65 |
| Water Content, wt. % | 0–0.1 |
| Oil Absorption, cc/100 gr | 60–75 |

The refining additives delivered via line 50 to mixer 48 have the effect to increase quinoline insoluble, conradson carbon and softening point in the case of carbon black. An additive of light gas oil improves the wettability of the pitch which would reduce the temperature and mixing time necessary when mixed with calcining petroleum coke during the manufacture of electrodes. The modified petroleum pitch product can be delivered via line 52 to a finishing station 54 where it is shaped as pencils or flakes prior to being send to storage via line 56.

Advantages of the present invention will be made clear from the following illustrative examples.

EXAMPLE 1

Petroleum tar pitch was prepared in accordance with the process of the present invention as schematically shown in the FIGURE. A fresh feed of catalytic cracking decanted oil having the following characteristics:

| | |
|---|---|
| Density @ 15° C. (gr/cc) | 1.068 |
| Conradson Carbon (wt. %) | 7 |
| Solids Content (wt. %) | 0.04 |
| Aromatics (wt. %) | 85 |

was filtered so as to reduce the solids content to below 0.01 wt. %. The filtered stream was thereafter mixed with a recycle stream in a ratio of 3:1 of volume recycle to filter clean stream. The recycle stream had the following properties:

| | |
|---|---|
| Conradson Carbon, (wt. %) | 15 |
| Density @ 15° C., (gr/cc) | 1.10 |
| Solids Content, (wt. %) | 0.01 |
| Aromatics, (wt. %) | 90 |
| Softening Point, (°C.) | <25 |

The resulting combined stream was thereafter preheated to a temperature of about 415° C. and fed to a soaker type reactor where the pre-heated combined stream was treated at a temperature of 408° C. at a pressure of 1653 kPa and a residence time of 3.7 hours. The treated stream was thereafter fractionated under the following conditions

| | |
|---|---|
| Bottom Fractionator Temperature, °C. | 380 |
| Pressure, kPa | 835 |

so as to produce a gas yield of 4 wt. % $C_4^-$, a light distillates yield of 7 wt. % having an ASTM D-86 cut point of between 170° and 220° C. and a bottom fraction. The bottom fraction having the following composition and properties:

| | |
|---|---|
| Bottom Fractionator Temperature, °C. | 343 |

-continued

| | |
|---|---|
| Pressure, kPa | 0.304 |

was thereafter divided into a recycle stream and a cracked fraction stream. The cracked fraction stream was thereafter subject to further fractionation under the following conditions

| | |
|---|---|
| Conradson Carbon, (wt. %) | 15 |
| Density @ 15° C., (gr/cc) | 1.15 |
| Solids Content, (wt. %) | 0.01 |
| Aromatics, (wt. %) | 90 |
| Softening Point, (°C.) | <25 |

so as to yield 21 wt. % light gas oil having an end boiling point of 343° C., 40 wt. % heavy gas oil having an end boiling point of 520° C. and petroleum tar pitch having the following properties:

| | |
|---|---|
| Conradson Carbon, (wt. %) | 55 |
| Density @ 15° C., (gr/cc) | 1.30 |
| Mettler Softening Point, (°C.) | 115 |
| Quinoline Insolubles, (wt. %) | 0 |

EXAMPLE 2

The petroleum tar pitch product of Example 1 was admixed with 10 wt. % finely divided carbon black having the following composition and properties:

| | |
|---|---|
| Average Particle Size, microns | 16 |
| Apparent Bulk Density, gr/cc | 0.60 |
| Water Content, wt. % | 0 |
| Oil Absorption, cc/100 gr | 60 |

The resultant petroleum tar pitch had the following composition and properties:

| | |
|---|---|
| Conradson Carbon, (wt. %) | 59 |
| Density @ 15° C., (gr/cc) | 1.32 |
| Mettler Softening Point, (°C.) | 120 |
| Quinoline Insolubles, (wt. %) | 9 |

EXAMPLE 3

The petroleum tar pitch product of Example 1 was admixed with 12 volume percent light gas oil having the following composition and properties:

| | |
|---|---|
| ASTM D-86 Initial Boiling Point, °C. | 205 |
| ASTM D-86 Final Boiling Point, °C. | 350 |
| API Gravity | 19 |
| Aromatics, wt. % | 80 |

The resultant petroleum tar pitch had the following composition and properties:

| | |
|---|---|
| Conradson Carbon, (wt. %) | 50 |
| Density @ 15° C., (gr/cc) | 1.239 |
| Mettler Softening Point, (°C.) | 105 |
| Quinoline Insolubles, (wt. %) | 0 |

EXAMPLE 4

The petroleum tar pitch product of Example 1 was admixed with 10 wt. % finely divided carbon black and 12 volume percent light gas oil having the properties set forth above in Examples 2 and 3. The resultant petroleum tar pitch had the following composition and properties:

| | |
|---|---|
| Conradson Carbon, (wt. %) | 52 |
| Density @ 15° C., (gr/cc) | 1.29 |
| Mettler Softening Point, (°C.) | 112 |
| Quinoline Insolubles, (wt. %) | 8 |

As can clearly be seen from the foregoing examples, the process of the present invention allows for the production of high quality petroleum tar pitch from a highly aromatic feed. The process of the present invention allows for the economic production of petroleum tar pitch suitable for use as a binder in the manufacture of electrodes for use in the aluminum and steel industries.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the production of high quality petroleum tar pitch comprising:
   (a) providing a fresh hydrocarbon feedstock;
   (b) pre-heating said feedstock in a furnace to a temperature of about between 380° to 480° C.;
   (c) feeding said heated feedstock to a reactor and treating said feedstock in said reactor under controlled conditions so as to promote condensation and polymerization reactions;
   (d) passing said treated feedstock to a fractionating tower wherein said feedstock is fractionated into (1) gases, (2) light distillates and (3) a bottom fraction stream;
   (e) dividing said bottom fraction stream into a recycle stream and a cracked fraction stream;
   (f) feeding said cracked fraction stream to a reduced pressure distillation tower wherein said light cracked fraction is further fractionated into (1) light gas oil, (2) heavy gas oil and (3) a high quality petroleum tar pitch; and
   (g) recycling said recycled stream and admixing said recycled stream with said fresh feedstock.

2. A process according to claim 1 wherein said recycle stream is admixed with said fresh feedstock in a ratio of up to 3:1 by volume recycle stream to fresh feedstock.

3. A process according to claim 2 wherein said recycle is admixed with said fresh feedstock in a ratio of about between 2:1 to 3:1 by volume recycle stream to fresh feedstock.

4. A process according to claim 1 wherein said fresh feedstock is a highly aromatic hydrocarbon feedstock.

5. A process according to claim 4 wherein said hydrocarbon feedstock is selected from the group consisting of catalytic cracking decanted oil, lubricant extracts and mixtures thereof.

6. A process according to claim 4 wherein said hydrocarbon feedstock has the following composition and properties:

| | |
|---|---|
| Conradson Carbon, (wt. %) | 3–10 |
| Density @ 15° C., (gr/cc) | 0.8–1.1 |
| Solids Content, (wt. %) | 0–0.1 |
| Aromatics, (wt. %) | 65–85 |

7. A process according to claim 6 comprising filtering said hydrocarbon feedstock prior to pre-heating so as to remove undesirable solid and produce a filtered feedstock.

8. A process according to claim 7 wherein said filtered feedstock has the following composition and properties:

| | |
|---|---|
| Conradson Carbon, (wt. %) | 3–7 |
| Density @ 15° C., (gr/cc) | 0.8–1.1 |
| Solids Content, (wt. %) | 0–0.1 |
| Aromatics, (wt. %) | 65–85 |

9. A process according to claim 1 wherein the feedstock is fractionated in an inert environment.

10. A process according to claim 1 wherein the feedstock is fractionated in substantially oxygen free environment.

11. A process according to claim 1 wherein steps (b), (c), (d) and (f) take place in a substantially oxygen free environment.

12. A process according to claim 1 wherein said feedstock is fractionated in step (d) to yield 2 to 5 wt. % $C_4^-$ gases and 3 to 8 wt. % light distillates having an ASTM D-86 cut point of between 170° C. and 220° C. based on fresh feed.

13. A process according to claim 1 wherein said bottom fraction stream has the following composition and properties:

| | |
|---|---|
| Conradson Carbon, (wt. %) | 10–18 |
| Density @ 15° C., (gr/cc) | 1.10–1.15 |
| Solids Content, (wt. %) | 0–0.01 |
| Aromatics, (wt. %) | 70–95 |
| Softening Point, (°C.) | <25 |

14. A process according to claim 1 wherein said recycle stream has the following composition and properties:

| | |
|---|---|
| Conradson Carbon, (wt. %) | 10–18 |
| Density @ 15° C., (gr/cc) | 1.10–1.15 |
| Solids Content, (wt. %) | 0–0.01 |
| Aromatics, (wt. %) | 70–95 |
| Softening Point, (°C.) | <25 |

15. A process according to claim 1 wherein said cracked fraction stream is further fractionated to yield the following products:

| | ASTM D-1160 End Point | Wt. % |
|---|---|---|
| Light Gas Oil | 300–360° C. | 15–25 |
| Heavy Gas Oil | 450–570° C. | 30–50 |
| Petroleum Tar Pitch | | 25–53 |

16. A process according to claim 1 wherein said light cracked fraction is further fractionated under the following conditions: bottom fractionator temperature, ° C., 300–380; pressure, kPa, 0.3–15.

17. A process according to claim 1 wherein the petroleum tar pitch of step (f) is mixed with a refining element selected from the group consisting of fine divided carbon black, a light gas oil or mixtures thereof.

18. A process according to claim 17 wherein said refining element in the light gas oil is a product of step (f).

19. A process according to claim 17 wherein said refining element is added in an amount of between 3 to 20 wt. %.

20. A process according to claim 17 wherein said finely divided carbon black has the following properties:

| | |
|---|---|
| Average Particle Size, microns | 12–20 |
| Apparent Bulk Density, gr/cc | 0.46–0.65 |
| Water Content, wt. % | 0–0.1 |
| Oil Absorption, cc/100 gr | 60–75 |

21. A process according to claim 17 wherein said light gas oil has the following properties:

| | |
|---|---|
| ASTM D-86 Initial Boiling Point, °C. | 170–220 |
| ASTM D-86 Final Boiling Point, °C. | 300–360 |
| API Gravity | 18–28 |
| Aromatics, wt. % | 45–80 |

22. A process according to claim 1 wherein step (c) takes place under the following conditions:

| | |
|---|---|
| Temperature, °C. | 360–460 |
| Pressure, kPa | 1480–1825 |
| Residence Time, hr. | 1–5 |

23. A process according to claim 1 wherein step (d) takes place under the following conditions:

| | |
|---|---|
| Bottom Fractionator Temperature, °C. | 330–430 |
| Pressure, kPa | 700–850 |

24. A process according to claim 1 wherein said high quality petroleum tar pitch has the following properties:

| | |
|---|---|
| Conradson Carbon, (wt. %) | 40–60 |
| Density @ 15° C., (gr/cc) | 1.20–1.35 |
| Mettler Softening Point, (°C.) | 100–125 |
| Quinoline Insolubles, (wt. %) | 0–10 |

25. A process according to claim 1 wherein said recycled stream is admixed with said fresh hydrocarbon feedstock prior to preheating.

* * * * *

UNITED STATES PATENT AND TRADEMARK OFFICE

CERTIFICATE OF CORRECTION

PATENT NO. : 4,961,837

DATED : October 9, 1990

INVENTOR(S) : Leon Velasco et al.

It is certified that error appears in the above-identified patent and that said Letters Patent is hereby corrected as shown below:

Column 8, line 34, delete "$C_4$-"
and insert --$C_4^-$--

Signed and Sealed this

Twelfth Day of May, 1992

*Attest:*

DOUGLAS B. COMER

*Attesting Officer*

*Acting Commissioner of Patents and Trademarks*